US009055623B1

(12) United States Patent
Bohler et al.

(10) Patent No.: US 9,055,623 B1
(45) Date of Patent: Jun. 9, 2015

(54) LIGHT-EMITTING DIODE OFFLINE BUCK CONVERTER AND METHOD OF CONTROLLING THEREOF

(71) Applicants: Christopher Lee Bohler, Peachtree City, GA (US); Li Li, Peachtree City, GA (US)

(72) Inventors: Christopher Lee Bohler, Peachtree City, GA (US); Li Li, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 50 days.

(21) Appl. No.: 13/797,167

(22) Filed: Mar. 12, 2013

Related U.S. Application Data

(60) Provisional application No. 61/613,328, filed on Mar. 20, 2012.

(51) Int. Cl.
*H05B 37/02* (2006.01)

(52) U.S. Cl.
CPC ..... *H05B 37/02* (2013.01)

(58) Field of Classification Search
CPC ..... H05B 33/0815; H05B 37/02
USPC ..... 315/209 R, 247, 291, 307, 308
See application file for complete search history.

(56) References Cited

U.S. PATENT DOCUMENTS

| | | | | |
|---|---|---|---|---|
| 7,750,616 | B2 | 7/2010 | Liu | |
| 8,324,832 | B2 * | 12/2012 | Yan et al. | 315/291 |
| 8,569,964 | B2 * | 10/2013 | Xu et al. | 315/209 R |
| 2010/0308733 | A1 * | 12/2010 | Shao | 315/119 |

* cited by examiner

*Primary Examiner* — Thuy Vinh Tran
(74) *Attorney, Agent, or Firm* — King & Spalding LLP

(57) ABSTRACT

A method for controlling a buck converter of an alternating current (AC)-powered light emitting diode (LED) circuit. The method includes receiving an input voltage, and converting the input voltage to a feedback voltage. The method can also include sending the feedback voltage to the buck converter. The feedback voltage is proportional to the input voltage by a first factor when the input voltage is less than an upper threshold voltage and greater than a lower threshold voltage. The feedback voltage is proportional to the input voltage by a second factor when the input voltage is at least as great as the upper threshold voltage. The upper threshold voltage is less than a maximum voltage of the input voltage.

20 Claims, 6 Drawing Sheets

LIGHT-EMITTING DIODE OFFLINE BUCK CONVERTER AND METHOD OF CONTROLLING THEREOF

CROSS-REFERENCE TO RELATED APPLICATIONS

This application claims priority under 35 U.S.C. §119 to U.S. Provisional Patent Application Ser. No. 61/613,328, titled "LED Offline Buck Converter" and filed on Mar. 20, 2012, the entire contents of which are hereby incorporated herein by reference.

TECHNICAL FIELD

Embodiments described herein relate generally to control circuits for a light-emitting diode (LED) fixture, and more particularly to systems, methods, and devices for providing a non-linear feedback circuit within a control circuit for a LED fixture.

BACKGROUND

LED drivers are used in LED lighting fixtures to send power and/or control signals to one or more LEDs in the lighting fixture. Thus, LED drivers perform a critical role in ensuring that the LEDs operate in a manner that maintains reliability and performance. A buck converter is a type of LED driver. A buck converter is used in a control circuit at times to regulate direct current (DC) supplied to a LED circuit. Specifically, the buck converter may be a step-down DC to DC converter powered with rectified line voltage. A feedback circuit is used to regulate the duty rate of a regulating switch based on output current and input voltage.

SUMMARY

In general, in one aspect, the disclosure relates to a method for controlling a buck converter of an alternating current (AC)-powered light emitting diode (LED) circuit. The method can include receiving an input voltage, and converting the input voltage to a feedback voltage. The method can also include sending the feedback voltage to the buck converter. The feedback voltage can be proportional to the input voltage by a first factor when the input voltage is less than an upper threshold voltage and greater than a lower threshold voltage. The feedback voltage can be proportional to the input voltage by a second factor when the input voltage is at least as great as the upper threshold voltage. The upper threshold voltage can be less than a maximum voltage of the input voltage.

In another aspect, the disclosure can generally relate to a light emitting diode (LED) circuit. The LED circuit can include a buck converter, and an array of LEDs electrically coupled to the buck converter. The LED circuit can also include a non-linear feedback circuit electrically coupled to the buck converter.

In yet another aspect, the disclosure can generally relate to a non-linear feedback circuit for a buck converter of a light-emitting diode (LED) lighting circuit. The non-linear feedback circuit can include a diode having an anode and a cathode. The non-linear feedback circuit can also include a number of resistors electrically coupled to the diode, where each of the resistors has a first end and a second end. The anode of the diode can be electrically coupled to the second end of a first resistor of the plurality of resistors and a first end of a second resistor of the plurality of resistors. The cathode of the diode can be electrically coupled to a power source and to the second end of a third resistor of the resistors. The first end of the first resistor can be electrically coupled to the power source. The second end of the second resistor can be electrically coupled to the first end of the third resistor.

These and other aspects, objects, features, and embodiments will be apparent from the following description and the appended claims.

BRIEF DESCRIPTION OF THE DRAWINGS

The drawings illustrate only example embodiments of LED offline buck converters and are therefore not to be considered limiting of its scope, as the LED offline buck converters may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
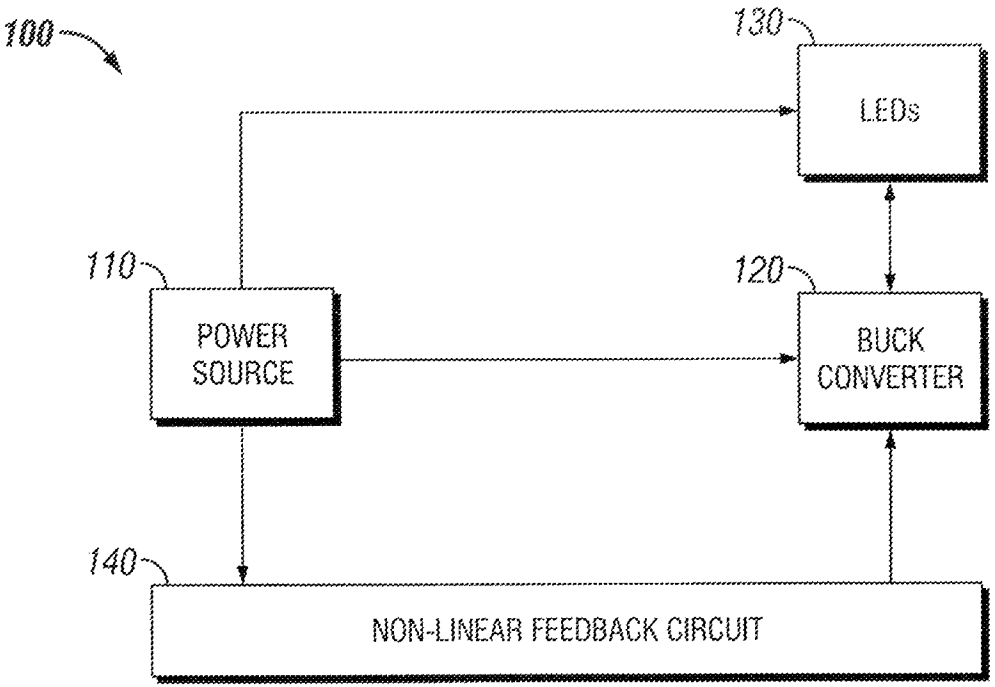
FIG. 1 shows a system diagram of an AC-powered LED circuit with a non-linear feedback circuit in accordance with one or more example embodiments.

The example embodiments discussed herein are directed to an offline buck converter for a LED circuit. Specifically, example embodiments may be directed to a non-linear feedback circuit that is operatively coupled to a buck converter within a LED circuit. The non-linear feedback circuit may also be operatively coupled to a control circuit of the LED circuit. Example embodiments of a non-linear feedback circuit will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a front end and a back end can each generally be described as lateral directions, such as for the ends of a resistor.

In one or more example embodiments, a non-linear feedback loop, operatively coupled to a LED offline buck converter, is described herein. Specifically, the power line voltage is sampled by a non linear circuit rather than by a linear circuit. The example non-linear circuit may be selected based on one or more of a number of performance targets. For example, power factor, transient response, line regulation, and/or total harmonic distortion (THD) may be optimized by choosing the appropriate feedback circuit response characteristics.

In certain example embodiments, the example LED offline buck converter lowers the power factor while maintaining a power factor at or near a target level (e.g., 0.9). In other words, when the power factor would normally be above a target level, example embodiments described herein lower the power factor toward the target level to achieve other benefits. Examples of such benefits include, but are not limited to improved surge response, improved line voltage regulation, and lower current ripple through the LEDs.

Example embodiments of a LED offline buck converter will be described more fully hereinafter with reference to the accompanying drawings, in which example embodiments of LED offline buck converters are shown. Example LED offline buck converters may, however, be embodied in many different forms and should not be construed as limited to the example embodiments set forth herein. Rather, these example embodiments are provided so that this disclosure will be thorough and complete, and will fully convey the scope of example LED offline buck converters to those or ordinary skill in the art. Like, but not necessarily the same, elements (also sometimes called components) in the various figures are denoted by like reference numerals for consistency.

FIG. 1 shows a system diagram of a LED circuit 100 with a non-linear feedback circuit in accordance with one or more example embodiments. The example LED circuit 100 includes a power source 110, a buck converter 120, an array of LEDs 130, and a non-linear feedback circuit 140. Each of these components is described below. In certain embodiments, one or more of the components shown in FIG. 1 may be omitted, repeated, and/or substituted. Accordingly, embodiments of a LED circuit with a non-linear feedback circuit should not be considered limited to the specific arrangements of components shown in FIG. 1.

The example power source 110 is electrically coupled to the non-linear feedback circuit 140. In one or more example embodiments, the power source 110 is any source of electric power that provides voltage and/or current to one or more other components of the LED circuit 100. The power received by the power source 110 may be transformed, rectified, inverted, converted, and/or otherwise manipulated so that the output of the power source 110 is in an appropriate form (e.g., DC, alternating current) and of an appropriate level (e.g., 24 VDC, 120 VAC) to operate the remainder of the LED circuit 100.

The LEDs 130 are electrically coupled to the power source 110 and the buck converter 120. The LEDs 130 can be any of a number of types of LEDs, including but not limited to chip-on-board. In one example embodiment, the LEDs 130 include one or more (an array of) LEDs coupled in series and/or in parallel. When more than one LED 130 is electrically coupled to each other, the LEDs 130 may be referred to as an array. An array of series-connected LEDs 130 may be one or more LEDs connected in series so that a current flows through all LEDs 130 in the array. In certain example embodiments, the LEDs 130 receive a sinusoidal voltage and/or current from the power source 110. When the voltage across the LEDs 130 exceeds the sum of the forward voltages of the LEDs 130, the LEDs 130 will conduct current (i.e., LEDs 130 will turn on). As the voltage increases, the current through the LEDs 130 also increases. After the current flows through the LEDs 130, the current flows to the buck converter 120. In certain embodiments, the current flowing through the LEDs 130 is controlled by the buck converter 120.

The buck converter 120 is electrically coupled to the example non-linear feedback circuit 140. The buck converter 120 is a step-down voltage converter according to certain example embodiments. The buck converter 120 is a form of LED driver that controls and/or regulates voltage and/or current flowing through the LEDs 130. The buck converter 120 may convert one DC voltage into a different DC voltage. The buck converter 120 may include one or more of a number of different components. Such components can include, but are not limited to, an integrated circuit (IC), an inductor, a diode, a transistor, and a resistor. The components of the buck converter 120 may be positioned and interconnected, mechanically and/or electrically, in one or more of a number of configurations. In certain embodiments, the buck converter 120 may be any type of voltage converter and/or LED driver and is not specifically limited to a buck converter as described herein.

The example non-linear feedback circuit 140 is electrically coupled to the power source 110 and the buck converter 120. Specifically, in one or more example embodiments, the non-linear feedback circuit 140 receives voltage and/or current from the power source 110. The non-linear feedback circuit 140 converts the voltage and/or alters the current received from the power source 110 and creates the input current (i.e., the current flowing to the buck converter 120), which in turn controls the output current (i.e., the current flowing through the LEDs 130). The non-linear feedback circuit 140 may consist of any of a number of solid state (e.g., integrated circuit) and/or discrete components. Examples of discrete components may include, but are not limited to, a resistor, a rectifier diode, a Zener diode. In addition, or in the alternative, the non-linear feedback circuit 140 can include a dual inline package (DIP) switch.

In certain example embodiments, the non-linear feedback circuit 140 (also called a non-linear conversion circuit) generates a feedback voltage (also called an input feed-forward voltage) that is delivered to the buck converter 120. The components of the non-linear feedback circuit 140 may be sized and configured in such a way as to generate different results based on a threshold voltage and/or a target power factor. For example, when a voltage delivered to the non-linear feedback circuit 140 is less than the threshold voltage, the non-linear feedback circuit 140 generates a feedback voltage that is linearly-proportional to the voltage. Alternatively, when the voltage delivered to the non-linear feedback circuit 140 exceeds the threshold voltage, the non-linear feedback circuit 140 generates a feedback voltage that is capped (also resulting in a maximum current).

The threshold voltage can be any voltage (or, in some cases, a current that is associated with a voltage) for a particular circuit that limits the current that the buck converter 120 delivers to the LEDs 130. Such a voltage can be, for example, 0.7 VDC. In certain example embodiments, the threshold voltage is determined based on a desired or target power factor. A non-exclusive example of a desired power factor can be 0.9.

Figure 2:
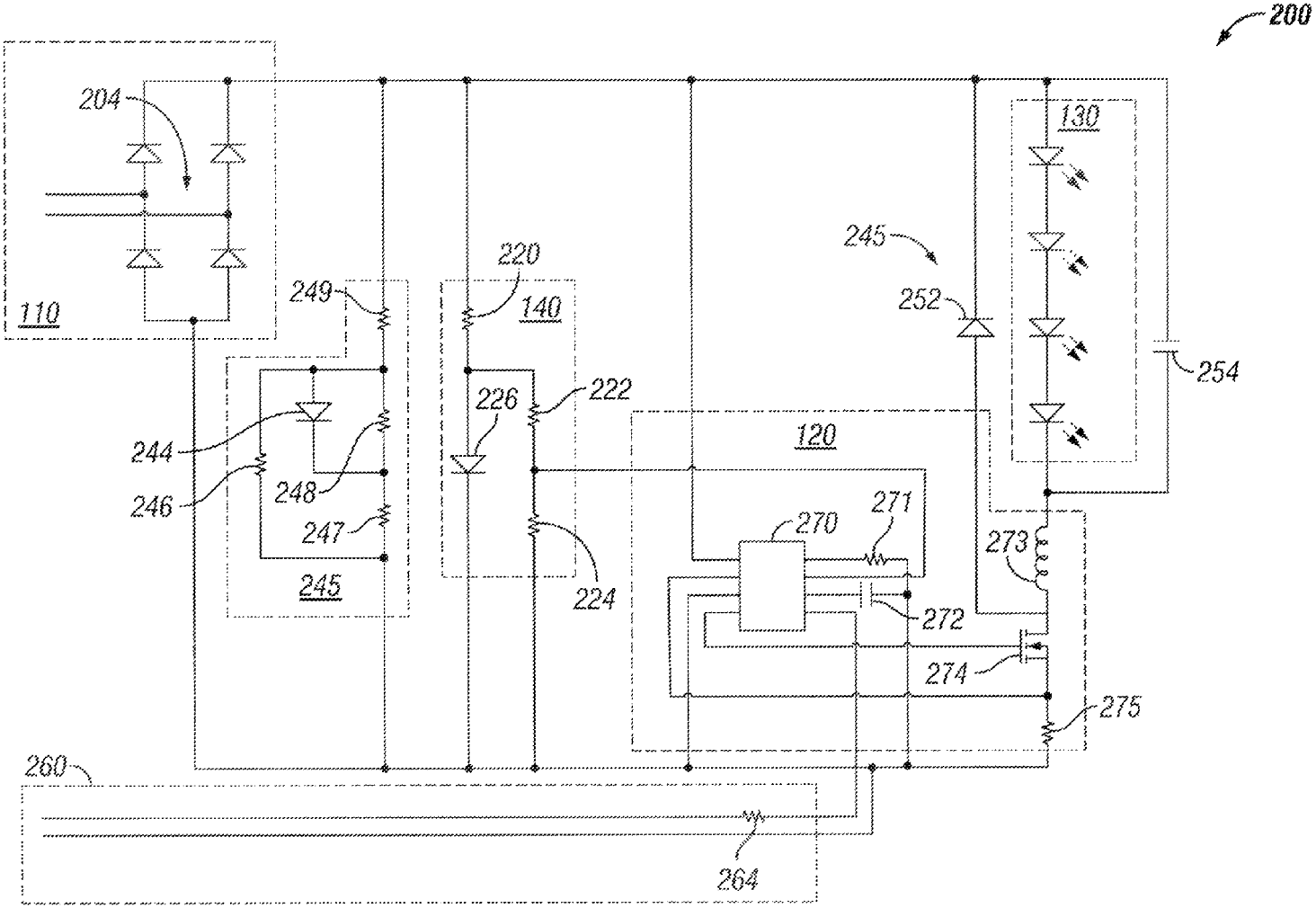
FIG. 2 presents a schematic diagram of an AC-powered LED circuit with a non-linear feedback circuit in accordance with one or more example embodiments.

FIG. 2 presents a schematic diagram of a LED circuit 200 with an example non-linear feedback circuit 140 in accordance with one or more example embodiments. In certain embodiments, one or more of the components shown in FIG. 2 may be omitted, added, repeated, and/or substituted. Accordingly, embodiments of a LED circuit with a non-linear feedback circuit should not be considered limited to the specific arrangements of components shown in FIG. 2.

Referring to FIGS. 1 and 2, the LED circuit 200 of FIG. 2 includes the power source 110, the buck converter 120, the LEDs 130, the non-linear feedback circuit 140, an optional pulse-width modulation (PWM) dimming circuit 260, and other optional circuitry 245. The power source 110, the buck converter 120, and the LEDs 130 are substantially similar to the corresponding components described above with respect to FIG. 1. In this case, the power source 110 receives AC power, which is rectified using a diode bridge 204. The buck converter 120 in this example includes a coordination circuit 270, a resistor 271, a resistor 275, a capacitor 272, an inductor 273, and a re-channel metal-oxide semiconductor field effect transistor (MOSFET) 274. In certain example embodiments, the coordination circuit 270 includes a comparator that compares the voltage (or current) from the non-linear feedback circuit 140 with a voltage (or current) from the LEDs 130. The coordination circuit 270 can include, but is not limited to, an IC, DIP switch, and/or discrete components.

In certain embodiments, if the PWM control signal falls below a certain level (current ripple) that can cause the LEDs 130 to flicker, capacitor 254, electrically coupled in parallel with some or all of the LEDs 130, can release current to boost the PWM control signal that flows through the LEDs 130. In such a case, the charge released by the capacitor 254 can reduce or eliminate the current ripple flowing through the LEDs 130 and the resulting flickering effect of the LEDs 130.

In one or more example embodiments, the LED circuit 200 optionally includes a PWM dimming circuit 260. The PWM dimming circuit 260 can generate a forward current that is adequate to drive the LEDs 130. The dimming using the PWM dimming circuit 260 is accomplished by intermittently providing and terminating current to the LEDs 130 at a high frequency that is not detectable to the human eye. For a lower dimming level, the PWM dimming circuit 260 provides shorter periods of current relative to not providing current to the LEDs 130.

The PWM dimming circuit 260 may include a PWM dimming switch (not shown) and a resistor 264. Output from the PWM dimming circuit 260 may be fed into the buck converter 120. The resistor 264 can be connected in series with the positive leg of the PWM dimming switch. The resistor 264 converts the voltage from the PWM dimming switch to a current, which is delivered to the buck converter 120. The amount of resistance of the resistor 264 may depend on one or more of a number of factors, including but not limited to the range of the PWM dimming switch 262.

The optional circuitry 245 may include one or more of a number of components and serve one or more of a number of functions to support the operation of the LED circuit 200. The components of the optional circuitry 245 can include one or more of a number of discrete components, integrated circuits, and/or software executed on a hardware processor. For example, as shown in FIG. 2, the optional circuitry 245 may be a combination of resistors (resistor 246, resistor 247, resistor 248, and resistor 249) and two diodes (diode 244 and diode 252). In this example, the optional circuitry 245 may be a feedback circuit that optimizes THD and power factor, while also increasing the LED ripple current.

In certain example embodiments, the non-linear feedback circuit 140 includes a resistor 220. In the example embodiment shown in FIG. 2, one end (e.g., a front resistor end) of the resistor 220 is electrically coupled to the output of the power source 110, while the other end (e.g., a rear resistor end) of the resistor 220 is electrically coupled to the anode of diode 226 and a first end of the resistor 222. The second end of the resistor 220 is electrically coupled to a first end of the resistor 224 and the control circuit 130. In this example, the second end of the resistor 220 is electrically coupled to the linear dimming input of an IC of the control circuit 130. The second end of resistor 222 and the cathode of diode 226 are electrically coupled to ground.

The components of the non-linear feedback circuit 140 may have any value suitable to control the input current delivered to the buck converter 120. For example, the resistor 220 may have a value of approximately 1.7 MΩ, the resistor 222 may have a value of approximately 5.1 kΩ, the resistor 224 may have a value of approximately 2.0 kΩ, and the diode 226 may have a value of approximately 0.7V. As another example, the resistor 220 may have a value of approximately 1.6 MΩ, the resistor 222 may have a value of approximately 4.5 kΩ, the resistor 224 may have a value of approximately 2.5 kΩ, and the diode 226 may have a value of approximately 0.7V. The components of the non-linear feedback circuit 140 may be discrete components and/or part of an integrated package (e.g., an IC, programmable logic controller, one or more DIP switches) that may or may not operate using software.

For the configuration shown in FIG. 2, the diode 226 serves to limit the voltage that is applied across resistor 222 and resistor 224, which in turn limits the reference voltage that is sent to the comparator of the buck converter 120.

Figure 3A:
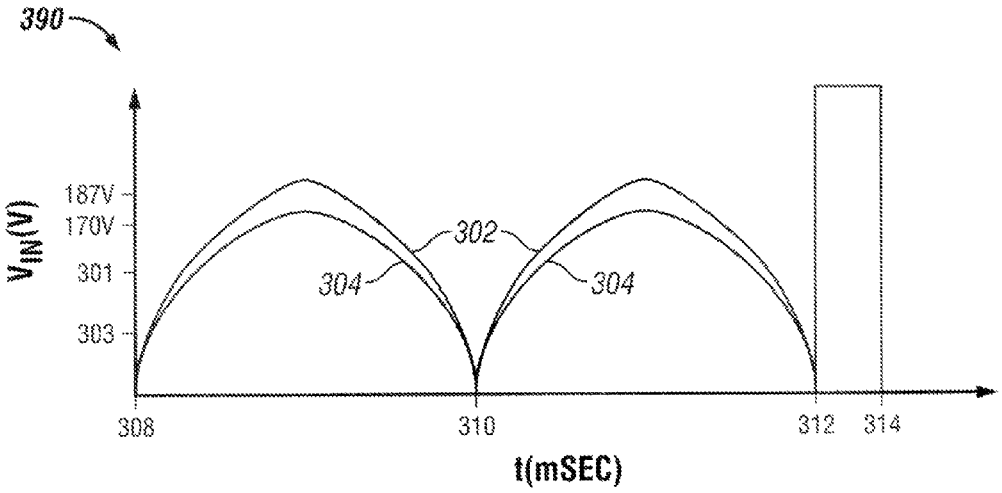
FIGS. 3A through 3D show various graphs of current and/or voltage versus time achieved with the LED circuit of FIG. 2 in accordance with one or more example embodiments.

FIGS. 3A through 3D show graphically how the non-linear feedback circuit contributes to the example LED offline buck converter of FIG. 2. Specifically, referring to FIGS. 1-3D, FIGS. 3A through 3D show a full cycle of power delivered to the LED circuit 200. The graph 390 of FIG. 3A shows voltage curves for an input voltage 302 of 132 VAC (with 187 VAC peak line voltage) and for an input voltage 304 of 120 VAC (with 170 VAC peak line voltage). Both input voltages 302 and 304 are the positive reflections of a full cycle of a sine wave starting at time 308, reaching the half-cycle point at time 310, and completing the cycle at time 312. Between times 312 and 314, a spike in the input voltage occurs during a surge condition, where the input voltages 302 and 304 far exceed their normal corresponding peaks.

Figure 3B:
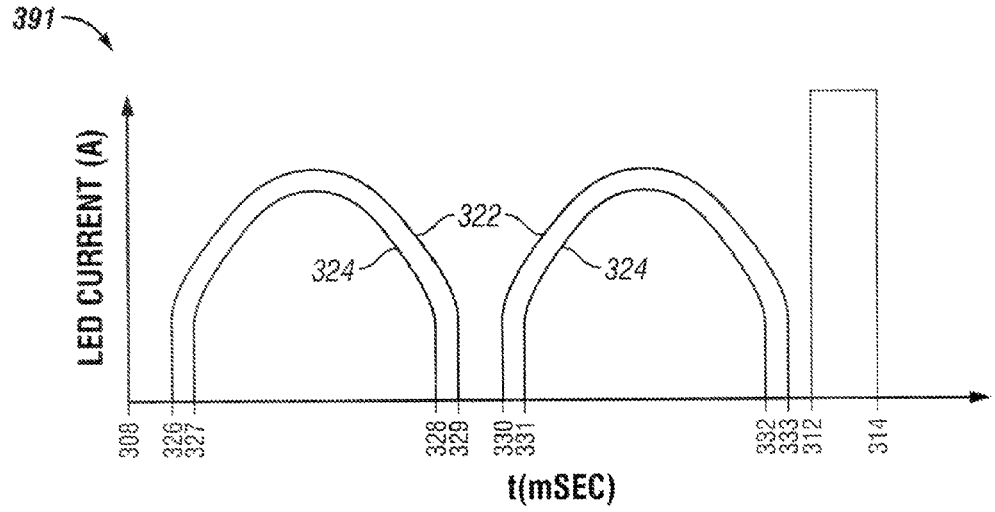

The graph 391 of FIG. 3B shows, for the same period of time, the LED current (i.e., output current, or current flowing through the LEDs) that would occur using a linear feedback circuit currently known in the art. In a typical buck converter, the feedback (output) can be compared to either a fixed reference voltage (not shown) or a reference voltage that is linearly related to the input voltage (as shown in FIG. 3B). With a fixed reference voltage, the power factor suffers. With a reference voltage that is linearly related to the input voltage, the circuit power factor is improved. Within a certain range of input and output voltage, the power factor improvement can be effective.

However, such a circuit has a few drawbacks, as shown in FIG. 3B. For example, the power factor of such a circuit is mostly determined by the input and output voltage ratio, and so the power factor may be overcompensated or insufficiently compensated. When the power factor is higher than it needs to be (e.g., 0.95 instead of 0.9), the current ripple through the LEDs 130 becomes more pronounced and noticeable to the human eye.

As another example, a circuit that uses a reference voltage that is linearly related to the input voltage has undesirable line regulation because when line voltage changes, the LED current will swing accordingly in a linear fashion. In other words, if the input voltage increases by 10%, the LED current increases by 10%. When line power surges, the LED current will increase sharply with the surge, as shown between times 312 and 314 in FIG. 3B, and potentially damage the LEDs 130. Specifically, the LED current 322 corresponds to the input voltage 302, and the LED current 324 corresponds to the input voltage 304.

As the input voltage approaches a lower threshold voltage (e.g., when the input voltage is less than 50 VAC), the LED currents 322 and 324 are at or near zero. In this example, the LED current 322 is at or near zero between times 308 and 326, times 329 and 330, and times 333 and 312. In some cases, the LED current 324 may remain at or near zero until the input voltage 304 reaches a lower threshold voltage (which may be the same or different than the lower threshold voltage for the input voltage 302). In this example, the LED current 324 is at or near zero between times 308 and 327, times 328 and 331, and times 332 and 312. However, once the input voltages 302 and 304 exceed the lower threshold voltage (also called a minimum voltage), the corresponding LED current 322 and 324 increases proportionately.

As stated above, this exposes one disadvantage of the linear feedback system shown in FIG. 3B in that, as the input voltages spike, as shown between times 312 and 314, the LED currents 322 and 324 also spike excessively. Such a spike or surge in the LED currents 322 and 324 can cause temporary or permanent damage to one or more components in the LED circuit 200.

Figure 3C:
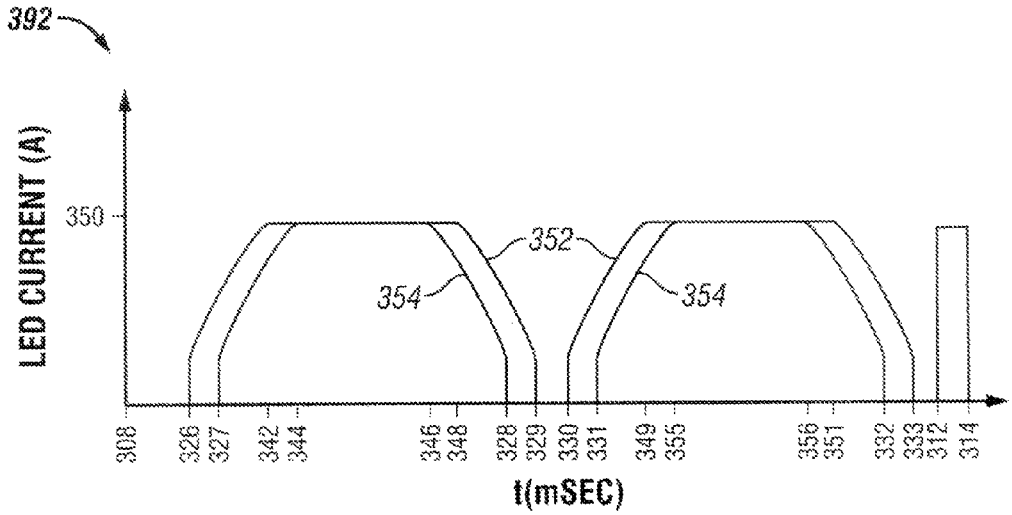

The graph 392 of FIG. 3C shows that, using an example non-linear feedback circuit, such as the non-linear feedback circuit 140 of FIGS. 1 and 2, the LED currents 352, 354 can be limited at current level 350. In FIG. 3C, once the lower threshold voltage (the minimum voltage) (e.g., voltage 303 shown in FIG. 3A above) is met, as the input voltages increase but remains below an upper threshold voltage (e.g., voltage 301 shown in FIG. 3A), the LED currents 352, 354 correspondingly increase until the upper threshold voltage is reached. Put another way, as the input voltage is between the lower threshold voltage and the upper threshold voltage, the non-linear feedback circuit 140 generates a feedback voltage that is proportional to the input voltage by a first factor. When the buck converter 120 receives the feedback voltage, the buck converter 120 generates a LED current (as shown in FIG. 3C) based on the feedback voltage.

When the input voltage is at or above the threshold voltage, the LED currents 352, 354 can remain at or near a relatively constant current level 350. Put another way, as the input voltage is at or exceeds the upper threshold voltage, the non-linear feedback circuit 140 generates a feedback voltage that is proportional to the input voltage by a second factor that is less than the first factor used when the input voltage is between the lower threshold voltage and the upper threshold voltage. Again, when the buck converter 120 receives the feedback voltage, the buck converter 120 generates a LED current (as shown in FIG. 3C) based on the feedback voltage.

To keep the LED current constant (capped) when the input voltage is at least as great as the upper threshold voltage, the second factor can vary, but remain less than the first factor. In certain example embodiments, there can be more than one linear feedback section. For example, there can be an intermediate threshold voltage that is greater than the lower threshold voltage and less than the upper threshold voltage. In such a case, when the input voltage is between the lower threshold voltage and the intermediate threshold voltage, the non-linear feedback circuit 140 generates a feedback voltage that is proportional to the input voltage by the first factor. When the input voltage is between the intermediate threshold voltage and the upper threshold voltage, the non-linear feedback circuit 140 generates a feedback voltage that is proportional to the input voltage by a third factor, which is less than the second factor (used when the input voltage at least equals the upper threshold voltage) and more than the first factor.

In certain example embodiments, in such a case, the third factor can vary to keep the LED current at a constant level when the input voltage is between the intermediate threshold voltage and the upper threshold voltage. In addition, or in the alternative, the second factor can be negative, or cause the LED current to move inversely (e.g., decrease when the input voltage increases) to the change in the input voltage.

In certain example embodiments, the example non-linear feedback circuit 140 behaves the same as a linear feedback circuit when the input voltage is at or below the minimum voltage (the lower threshold voltage). For example, as shown in FIG. 3C, the LED current 352, which corresponds to input voltage 302, is at or near zero between times 308 and 326, times 329 and 330, and times 333 and 312. Also, the LED current 354, which corresponds to input voltage 304, is at or near zero between times 308 and 327, times 328 and 331, and times 332 and 312. The minimum voltage threshold can be equal to a forward voltage of the LEDs 130. In such a case, the LEDs 130 do not conduct when the input voltage does not exceed the forward voltage of the LEDs 130.

Using the disclosure described above for the non-linear feedback circuit 140, the LED current can be capped (a maximum current) or increase at a reduced rate when the corresponding input voltage exceeds a threshold voltage (e.g., an upper threshold voltage, an intermediate threshold voltage). For example, as shown in FIG. 3C, when the input voltage 302 (from FIG. 3A) reaches an upper threshold voltage (e.g., approximately 150 V at voltage 301 in FIG. 3A), the LED current 352 is capped at current level 350 (e.g., 1.0 A, 1.2 A) and remains at a substantially constant level between times 342 and 348 and times 349 and 351. In addition, and more importantly, as the input voltage 302 spikes between times 312 and 314, the LED current 352 is capped at current level 350.

In certain example embodiments, when the input voltage is at a threshold voltage, a change in the input voltage results in a reduced change in the LED current. In such a case, the threshold voltage can be the same as or different than the upper threshold voltage. In certain example embodiments, the threshold voltage can represent a range of voltages. For example, if a rising input voltage reaches a threshold voltage (in this case, the lower end of a range of voltages), then a 10% increase in the input voltage can result in a 3% increase in the LED current for as long as the input voltage is within the range. If the input voltage exceeds the range, which could coincide with a different threshold voltage (e.g., the upper threshold voltage), then a further change (e.g., a 15% increase) in the input voltage can result in an even smaller change (e.g., a 2% increase, no increase) in the LED current.

Similarly, when the input voltage 304 (of FIG. 3A) reaches an upper threshold voltage (which may be the same or different than the upper threshold voltage for the input voltage 302), the LED current 354 can be capped at current level 350 and remain at a substantially constant level between times 344 and 346 and times 355 and 356. Further, if the input voltage 304 spikes (as shown in FIG. 3C between times 312 and 314), the LED current 354 can be capped at a current level (e.g., current level 350). The capped current level 350 for LED current 354 may be substantially the same as the capped current level 350 for the LED current 352.

Further, when an input voltage exceeds an upper threshold voltage, the corresponding LED current, rather than being capped, may increase at a slower rate. For example, when the input voltage 302 (of FIG. 3A) is above the upper threshold voltage, for every 10% increase in the input voltage 302, the corresponding LED current 352 may only increase by 3%. Alternatively, the corresponding LED current 352 may increase by any other percentage greater than 0% and less than 10%. These caps, increases, and decreases in the LED current can be derived from a factor (e.g., first factor, second factor) applied by the non-linear feedback circuit 140 to the input voltage to generate a feedback voltage, as described above.

Figure 3D:
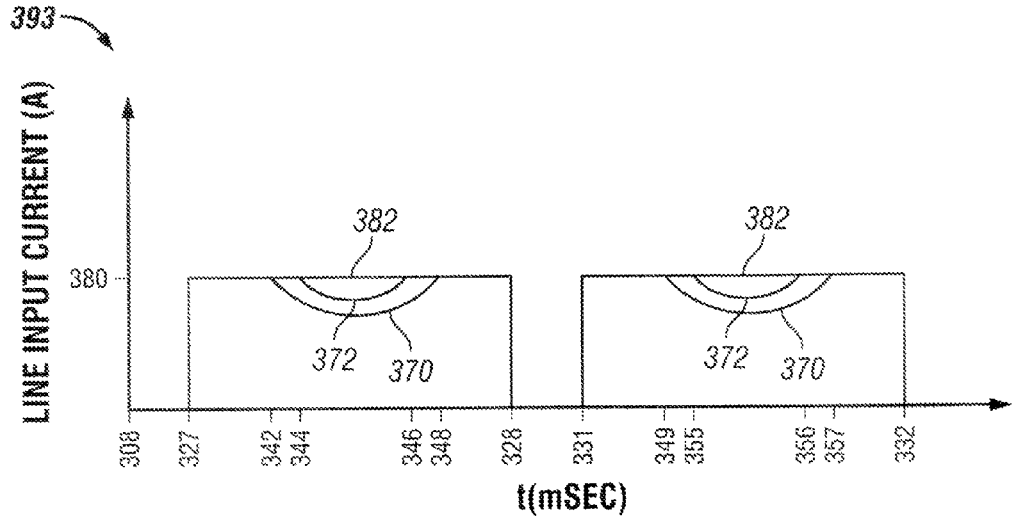

The graph 393 of FIG. 3D shows, using a non-linear feedback circuit 140 of FIG. 2, the line input current 372 (corresponding to the LED current 352) and the line input current 370 (corresponding to the LED current 354). The line input current represents the current that flows from the power source 110 to the rest of the LED circuit 100. In certain example embodiments, as shown in FIG. 3D, the line input currents 370 and 372 can be capped at current level 380 between times 344 and 346 and times 355 and 356. Further, the line input current 370 actually decreases slightly between times 342 and 348 and times 349 and 351, and the line input current 372 actually decreases slightly between times 344 and 346 and times 355 and 356. In certain example embodiments, the line input currents can decrease because the example non-linear feedback circuit 140 limits the LED current when the input voltage is in excess of the upper threshold voltage. The line input current 382 with a flat top shown in FIG. 3D is current waveform using a linear feedback circuit known in the art, as shown above with respect to FIG. 3B.

FIGS. 3C and 3D shows example waveforms using certain example non-linear feedback loop configurations described herein. Other non-linear feedback loop configurations using other example embodiments may be chosen to improve the same and/or one or more other performance targets, including but not limited to THD and power factor. Further, while threshold voltages are described herein, other threshold measurements (e.g., threshold currents) can be used in addition to, or in the alternative of, threshold voltages.

Figure 4:
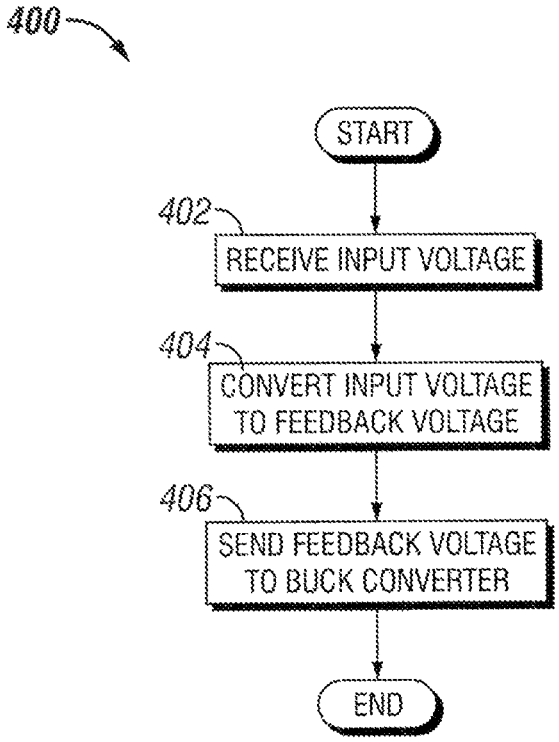
FIG. 4 is a flowchart diagram presenting a method for controlling a buck converter of an AC-powered LED circuit in accordance with one or more example embodiments.

FIG. 4 is a flowchart presenting an example method 400 for controlling a buck converter of an AC-powered LED circuit in accordance with one example embodiment. While the various steps in this flowchart are presented and described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order.

In addition, a person of ordinary skill in the art will appreciate that additional steps not shown in FIG. 4, may be included in performing this method. Accordingly, the specific arrangement of steps should not be construed as limiting the scope. In addition, a particular computing device, as described, for example, in FIG. 5 below, may be used to perform one or more of the steps for the method 400 described below.

Referring now to FIGS. 1, 2, and 4, the example method 400 begins at the START step and proceeds to step 402, where a voltage is received. In certain example embodiments, the voltage is an input voltage. The input voltage may be received, directly or indirectly, from a power source 110. Alternatively, a voltage may be converted using a rectifier, a transformer, an inverter, or any other voltage manipulation device and/or configuration to generate the input voltage. In such a case, the input voltage may be called a rectified AC line voltage. The voltage may be converted within the power source 110 using a bridge rectifier 204. In certain example embodiments, in addition to (or in the alternative of) the voltage, a current may be received. The voltage may be one of a continuous number of voltages, as when the power source 110 is an AC source.

In step 404, the input voltage is converted into a feedback voltage. In certain example embodiments, the input voltage is converted into the feedback voltage by the non-linear feedback circuit 140. The value of the feedback voltage can be based on one or more of a number of factors, including but not limited to whether the value of the input voltage (e.g., whether the input voltage exceeds any threshold voltages), the values of the components of the non-linear feedback circuit 140, and the settings of the non-linear feedback circuit 140.

In step 406, the feedback voltage is sent to the buck converter 120. In certain example embodiments, the feedback voltage is sent to the buck converter 120 by the non-linear feedback circuit 140. When the buck converter 120 receives the feedback voltage from the non-linear feedback circuit 140, the buck converter 120 generates a LED current based on the feedback voltage and sends the LED current to the LEDs 130.

In certain example embodiments, the non-linear feedback circuit 140 generates the feedback voltage based on whether the input voltage exceeds a threshold voltage. In certain example embodiments, there are multiple threshold voltages. For example, there can be a lower threshold voltage, one or more intermediate threshold voltages, and/or an upper threshold voltage. Each threshold voltage can be determined by the non-linear feedback circuit 140 if the non-linear feedback circuit 140 is an IC and/or executes software instructions using a hardware processor. Alternatively, the non-linear feedback circuit 140 can use discrete components that, based on their values, provide a certain feedback voltage for a given input voltage.

In certain example embodiments, there is at least a lower threshold voltage (which can correspond to the forward voltage of the LEDs 130) and an upper threshold voltage. In certain example embodiments, the feedback voltage is proportional to the input voltage by a first factor when the input voltage is less than an upper threshold voltage and greater than a lower threshold voltage. In addition, the feedback voltage can be proportional to the input voltage by a second factor when the input voltage is at least as great as the upper threshold voltage. In such a case, the second factor can be greater than the first factor. In certain example embodiments, the upper threshold voltage is less than a maximum voltage of the input voltage.

When there is an intermediate threshold voltage, the feedback voltage can be proportional to an intermediate threshold voltage by a third factor when the input voltage reaches the intermediate threshold voltage. In such a case, the intermediate threshold voltage can be less than the upper threshold voltage and greater than the lower threshold voltage. In addition, the third factor is greater than the second factor and less than the first factor.

In certain example embodiments, the second factor can be a negative number. In such a case, the third factor can vary in order to maintain the feedback voltage at a constant level when the input voltage is between the intermediate threshold voltage and the upper threshold voltage. In addition, or in the alternative, if the second factor is not negative, the second factor can vary in order to maintain the feedback voltage at a constant level when the input voltage exceeds the upper threshold voltage. The input voltage can correspond to an input current, where the input current decreases when the input voltage exceeds the upper threshold voltage. The current ripple of an LED can be reduced when the input voltage is at least as great as the upper threshold voltage. When step 406 is completed, the process then continues to the END step.

Figure 5:
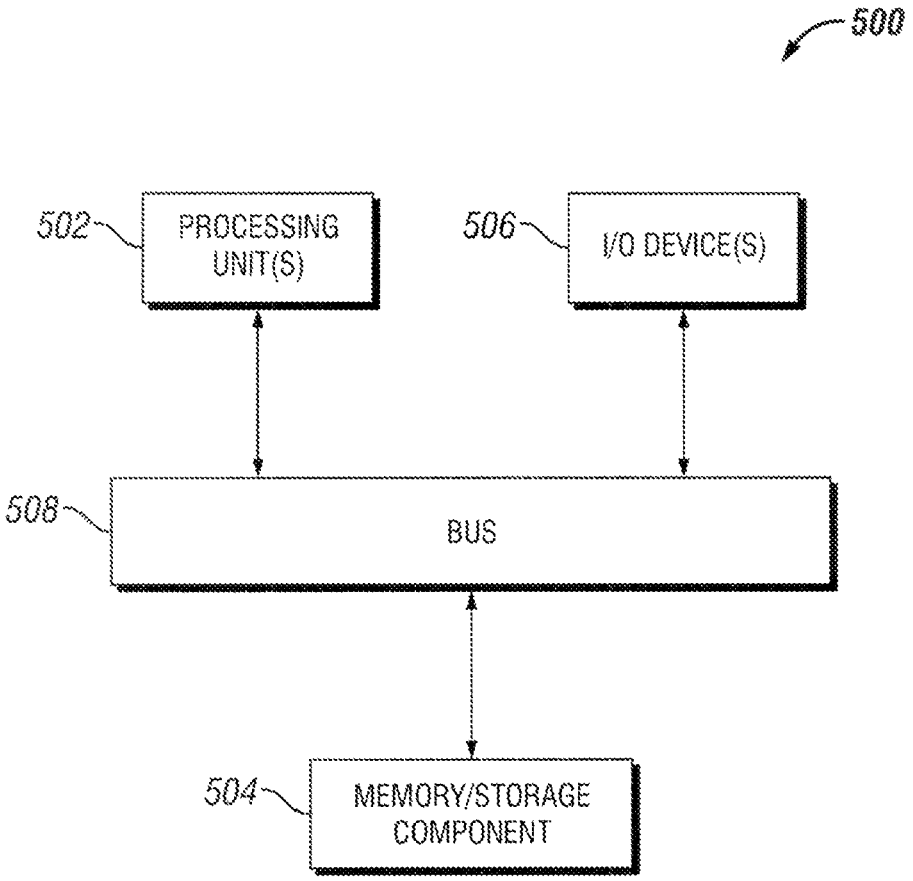
FIG. 5 shows a computer system used for controlling a buck converter of an AC-powered LED circuit in accordance with certain exemplary embodiments.

FIG. 5 illustrates one embodiment of a computing device 500 capable of implementing one or more of the various techniques described herein, and which may be representative, in whole or in part, of the elements described herein. Computing device 500 is only one example of a computing device and is not intended to suggest any limitation as to scope of use or functionality of the computing device and/or its possible architectures. Neither should computing device 500 be interpreted as having any dependency or requirement relating to any one or combination of components illustrated in the example computing device 500. As shown in FIG. 5, the bus 508 is operatively coupled to each of the processing unit(s) 502, the I/O device(s) 506, and the memory/storage component 504.

Computing device 500 includes one or more processors or processing units 502, one or more memory/storage components 504, one or more input/output (I/O) devices 506, and a bus 508 that allows the various components and devices to communicate with one another. Bus 508 represents one or more of any of several types of bus structures, including a memory bus or memory controller, a peripheral bus, an accelerated graphics port, and a processor or local bus using any of a variety of bus architectures. Bus 508 can include wired and/or wireless buses.

Memory/storage component 504 represents one or more computer storage media. Memory/storage component 504 may include volatile media (such as random access memory (RAM)) and/or nonvolatile media (such as read only memory (ROM), flash memory, optical disks, magnetic disks, and so forth). Memory/storage component 504 can include fixed media (e.g., RAM, ROM, a fixed hard drive, etc.) as well as removable media (e.g., a Flash memory drive, a removable hard drive, an optical disk, and so forth).

One or more I/O devices 506 allow a customer, utility, or other user to enter commands and information to computing device 500, and also allow information to be presented to the customer, utility, or other user and/or other components or devices. Examples of input devices include, but are not limited to, a keyboard, a cursor control device (e.g., a mouse), a microphone, and a scanner. Examples of output devices include, but are not limited to, a display device (e.g., a monitor or projector), speakers, a printer, and a network card.

Various techniques may be described herein in the general context of software or program modules. Generally, software includes routines, programs, objects, components, data structures, and so forth that perform particular tasks or implement particular abstract data types. An implementation of these modules and techniques may be stored on or transmitted across some form of computer readable media. Computer readable media may be any available non-transitory medium or non-transitory media that can be accessed by a computing device. By way of example, and not limitation, computer readable media may comprise "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The computer device 500 may be connected to a network (not shown) (e.g., a local area network (LAN), a wide area network (WAN) such as the Internet, or any other similar type of network) via a network interface connection (not shown). Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means may take other forms, now known or later developed. Generally speaking, the computer system 500 includes at least the minimal processing, input, and/or output means necessary to practice one or more embodiments.

Further, those skilled in the art will appreciate that one or more elements of the aforementioned computer device 500 may be located at a remote location and connected to the other elements over a network. Further, one or more exemplary embodiments may be implemented on a distributed system having a plurality of nodes, where each portion of the implementation (e.g., IC 270) may be located on a different node within the distributed system. In one or more embodiments, the node corresponds to a computer system. Alternatively, the node may correspond to a processor with associated physical memory. The node may alternatively correspond to a processor with shared memory and/or resources.

In one or more example embodiments, a LED offline buck converter improves response to surges, which reduces temporary and/or permanent damage to components of the LED circuit. Example embodiments further improve line voltage regulation. In addition, example embodiments reduce the occurrence and effects of LED current ripple. The threshold of a non-linear feedback circuit as described herein may be chosen to marginally meet a power factor requirement and, at higher currents and/or voltages, cap the LED current. As a result, LED current ripple is reduced, and line regulation and surge response are improved.

Accordingly, many modifications and other embodiments set forth herein will come to mind to one skilled in the art to which example LED offline buck converters pertain having the benefit of the teachings presented in the foregoing descriptions and the associated drawings. Therefore, it is to be understood that example LED offline buck converters are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A method for controlling a buck converter of an alternating current (AC)-powered light emitting diode (LED) circuit, the method comprising:

receiving an input voltage;

converting the input voltage to an input feed-forward voltage; and sending the input feed-forward voltage to the buck converter, wherein the input feed-forward voltage is proportional to the input voltage by a first factor when the input voltage is less than an upper threshold voltage and greater than a lower threshold voltage, wherein the input feed-forward voltage is proportional to the input voltage by a second factor when the input voltage is at least as great as the upper threshold voltage, and wherein the upper threshold voltage is less than a maximum voltage of the input voltage.

2. The method of claim 1, wherein the second factor is less than the first factor.

3. The method of claim 1, wherein the input voltage is variable.

4. The method of claim 1, wherein the buck converter sends a LED current to at least one LED, wherein the LED current is based on the input feed-forward voltage.

5. The method of claim 1, wherein the input feed-forward voltage is proportional to an intermediate threshold voltage by a third factor when the input voltage reaches the intermediate threshold voltage, wherein the intermediate threshold voltage is less than the upper threshold voltage and greater than the lower threshold voltage.

6. The method of claim 5, wherein the third factor is greater than the second factor and less than the first factor.

7. The method of claim 6, wherein the second factor is a negative number.

8. The method of claim 7, wherein the third factor varies in order to maintain the input feed-forward voltage at a constant level when the input voltage is between the intermediate threshold voltage and the upper threshold voltage.

9. The method of claim 6, wherein the second factor varies in order to maintain the input feed-forward voltage at a constant level when the input voltage exceeds the upper threshold voltage.

10. The method of claim 1, wherein the input voltage corresponds to an input current, wherein the input current decreases when the input voltage exceeds the upper threshold voltage.

11. The method of claim 1, wherein the lower threshold voltage is approximately equal to a forward voltage of an LED.

12. The method of claim 1, wherein a current ripple of an LED is reduced when the input voltage is at least as great as the upper threshold voltage.

13. A light emitting diode (LED) circuit, comprising:

a buck converter;

an array of LEDs electrically coupled to the buck converter; and a non-linear conversion circuit electrically coupled to the buck converter, wherein the non-linear conversion circuit receives an input voltage, converts the input voltage to an input feed-forward voltage, and sends the input feed-forward voltage to the buck converter, wherein the input feed-forward voltage is proportional to the input voltage by a first factor when the input voltage is less than an upper threshold voltage and greater than a lower threshold voltage, wherein the input feed-forward voltage is based on the input voltage by a second factor when the input voltage is at least as great as the upper threshold voltage, and wherein the upper threshold voltage is less than a maximum voltage of the input voltage.

14. The LED circuit of claim 13, further comprising:

a power source electrically coupled to the buck converter, the array of LEDs, and the non-linear conversion circuit, wherein the power source generates a voltage.

15. The LED circuit of claim 13, wherein the non-linear conversion circuit comprises a diode and a plurality of resistors.

16. The LED circuit of claim 15, wherein the plurality of resistors comprises a first resistor having a first front resistor end and a first rear resistor end, a second resistor having a second front resistor end and a second rear resistor end, and a third resistor having a third front resistor end and a third rear resistor end.

17. The LED circuit of claim 16, wherein the first front resistor end of the first resistor is electrically coupled to the power source, wherein the first rear resistor end of the first resistor is electrically coupled to an anode of the diode and the second front resistor end of the second resistor, wherein the second rear resistor end of the second resistor is electrically coupled to the third front resistor end of the third resistor and the non-linear conversion circuit, and wherein the third rear resistor end of the third resistor is electrically coupled to a cathode of the diode and the power source.

18. The LED circuit of claim 16, wherein the first resistor has a value of approximately 1.7 megaohms (MΩ), the second resistor has a value of approximately 5.1 kΩ, the third resistor has a value of approximately 2.0 kΩ, and the diode has a value of approximately 0.7 V.

19. The LED circuit of claim 16, wherein the first resistor has a value of approximately 1.6 megaohms (MΩ), the second resistor has a value of approximately 4.5 kΩ, the third resistor has a value of approximately 2.5 kΩ, and the diode has a value of approximately 0.7 V.

20. A non-linear conversion circuit for a buck converter of a light-emitting diode (LED) lighting circuit, comprising:

a diode comprising an anode and a cathode; and a plurality of resistors electrically coupled to the diode, wherein each of the plurality of resistors comprises a first end and a second end, wherein the anode of the diode is electrically coupled to the second end of a first resistor of the plurality of resistors and a first end of a second resistor of the plurality of resistors, wherein the cathode of the diode is electrically coupled to a power source and to the second end of a third resistor of the plurality of resistors, wherein the first end of the first resistor is electrically coupled to the power source, wherein the second end of the second resistor is electrically coupled to the first end of the third resistor, wherein the diode and the plurality of resistors receive an input voltage from the power source, convert the input voltage to an input feed-forward voltage, and send the input feed-forward voltage to the buck converter, wherein the input feed-forward voltage is proportional to the input voltage by a first factor when the input voltage is less than an upper threshold voltage and greater than a lower threshold voltage, wherein the input feed-forward voltage is based on the input voltage by a second factor when the input voltage is at least as great as the upper threshold voltage, and wherein the upper threshold voltage is less than a maximum voltage of the input voltage.

* * * * *